US005626253A

United States Patent [19]

Schütz

[11] Patent Number: 5,626,253

[45] Date of Patent: May 6, 1997

[54] BULK MATERIAL CONTAINER WITH AN EMPTYING ARRANGEMENT

[76] Inventor: Gerhard Schütz, Hintere Grundstrasse 11, CH-8320 Fehratorf, Switzerland

[21] Appl. No.: 464,843

[22] PCT Filed: Oct. 25, 1993

[86] PCT No.: PCT/CH93/00250

§ 371 Date: Jun. 7, 1995

§ 102(e) Date: Jun. 7, 1995

[87] PCT Pub. No.: WO95/10466

PCT Pub. Date: Apr. 20, 1995

[30] Foreign Application Priority Data

Oct. 8, 1993 [CH] Switzerland ..... 3033/93

[51] Int. Cl.[6] ..... B65D 90/04; B65D 6/34

[52] U.S. Cl. ..... 220/401; 220/402; 220/408; 220/653; 222/509; 222/559

[58] Field of Search ..... 220/730, 401, 220/402, 410, 1.5, 441, 442, 500, 653, 408, 409; 206/202, 449; 222/185.1, 509, 559

[56] References Cited

U.S. PATENT DOCUMENTS

| | | | |
|---|---|---|---|
| 2,782,011 | 2/1957 | Fitzgerald | 222/185.1 X |
| 3,048,450 | 8/1962 | Aller | 222/559 X |
| 3,863,799 | 2/1975 | Thomaswick et al. | 220/1.5 |
| 4,295,431 | 10/1981 | Starlo | 220/1.5 X |
| 4,410,111 | 10/1983 | Barger | 222/509 |
| 4,662,532 | 5/1987 | Anderson et al. | 220/1.5 X |
| 5,020,695 | 6/1991 | de Almeida Thompson et al. | 222/185.1 |
| 5,145,073 | 9/1992 | Kitagawa et al. | 206/449 X |
| 5,186,351 | 2/1993 | Gallo et al. | 220/402 |
| 5,449,095 | 9/1995 | Kobayashi | 222/DIG. 1 X |

*Primary Examiner*—Allan N. Shoap
*Assistant Examiner*—Niki M. Kopsidas
*Attorney, Agent, or Firm*—Jenkens & Gilchrist, a Professional Corporation

[57] ABSTRACT

Apparatus for storing and dispensing bulk materials such as sand, gravel and coke and which has at least one base emptying aperture. The apparatus includes a frame formed in the general shape of a box and a container formed in the general shape of a box for vertical movement within the frame. The frame includes at least one vertical strut at each corner connected by horizontal struts and four metal side plates. The container includes a guide attached at each corner formed to slide along the corresponding vertical strut at that corner. A plurality of roof-shaped webs are connected to and extend between the metal side plates extending along the length of the frame and are positioned to provide an aperture between adjacent roof-shaped webs. A plurality of roof-shaped webs are connected to and extend between the sides of the container and are positioned to provide an aperture between adjacent roof-shaped webs such that a roof-shaped web in the container is in vertical alignment with the aperture between adjacent roof-shaped webs of the frame and a roof-shaped web in the frame is in vertical alignment with the aperture between adjacent roof-shaped webs of the container to close the apertures when the container is positioned within the frame. When the container is raised relative to the frame, the bulk material in the container can empty out through the apertures.

12 Claims, 6 Drawing Sheets

BULK MATERIAL CONTAINER WITH AN EMPTYING ARRANGEMENT

BACKGROUND OF THE INVENTION

1. Field of the Invention

The present invention relates to a device for containing bulk material which has a base emptying arrangement and, more particularly, to a device for storing and dispensing bulk materials such as sand, gravel, coke, and other materials of that type.

2. History of the Related Art

Basically two types of containers relating to storing and dispensing bulk material are known from the patent literature and from technical applications. Those which are known primarily for the management of waste glass (for example those according to patent application PCT/NL92/00228) and those which are, most of the time, designed as hoppers for railway wagons or cars, and which have an emptying aperture, operated by a lid.

Waste glass containers generally have individual apertures, through which the glass, primarily bottles, can be inserted. The waste glass containers remain for a certain time period at a waste-product collection site, and they are then removed by special trucks and replaced by empty containers. The emptying takes place either in the glass plant or at a railroad station by lifting of the container shell or by lowering the base, which is pyramid or cone-shaped. Such containers are designed in accordance with the loading and unloading speed, and with the amount of collected material.

In the case of the second type of container, loading as well as unloading is characterized by a high-speed mass flow. Special devices (called train hoppers) are also necessary for unloading. The storage, preceding loading and following unloading, requires special storage devices, called silos. The use of such bulk material containers designed as tops of railroad wagons or cars require a large amount of capital, for the container itself, for the silos, and for the train hoppers. In addition to that, the unit to be used is always at least one entire wagon or car, even if it is only to be partially filled. Reloading onto trucks requires further devices and either a special truck or special tops for miscellaneous distribution.

The present invention provides an improvement over the prior art by providing a bulk material container, which can be emptied through the bottom without a lid-device, which can be built in different sizes (also as an ISO standard container), which makes silos superfluous, or at least limits the need for them, which is simple, robust, and maintenance-friendly, and which has no attached electrical, pneumatic, and/or hydraulic ancillary devices for emptying.

SUMMARY OF THE INVENTION

The present invention relates to apparatus for storing and dispensing bulk materials such as sand, gravel and coke and which has at least one base emptying aperture. More particularly, one aspect of the present invention comprises a frame formed in the general shape of a box and a container formed in the general shape of a box for vertical movement within the frame. The upward vertical movement of the box relative to the frame opens apertures in the frame and the box to allow the bulk material to empty from the container.

Another aspect of the present invention relates to the apparatus described above wherein the frame includes vertical struts formed of square tubes; horizontal struts which are connected to the upper end portion of the vertical struts; metal side plates which are connected to the lower end portion of the vertical struts and a plurality of roof-shaped webs extending between the metal side plates extending along the length of the frame. The plurality of roof-shaped webs are positioned along the length of the frame to provide an aperture between adjacent roof-shaped webs.

Another aspect of the present invention relates to the apparatus described above wherein the container includes a guide attached to each corner of the container for sliding contact with the adjacent vertical strut of the frame during vertical movement of the container relative to the frame. The lower portion of the container is retracted in the shape of a truncated pyramid and includes a plurality of roof-shaped webs which extend between the sides extending along the length of the container. The plurality of roof-shaped webs are positioned along the length of the container to provide an aperture between adjacent roof-shaped webs such that a roof-shaped web is in vertical alignment with the apertures between adjacent roof-shaped webs of the frame when the container is positioned within the frame. When the container is moved upwardly relative to the frame, the apertures between adjacent roof-shaped webs in the frame and in the container are opened to release the bulk material in the container.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DETAILED DESCRIPTION

Figure 1:
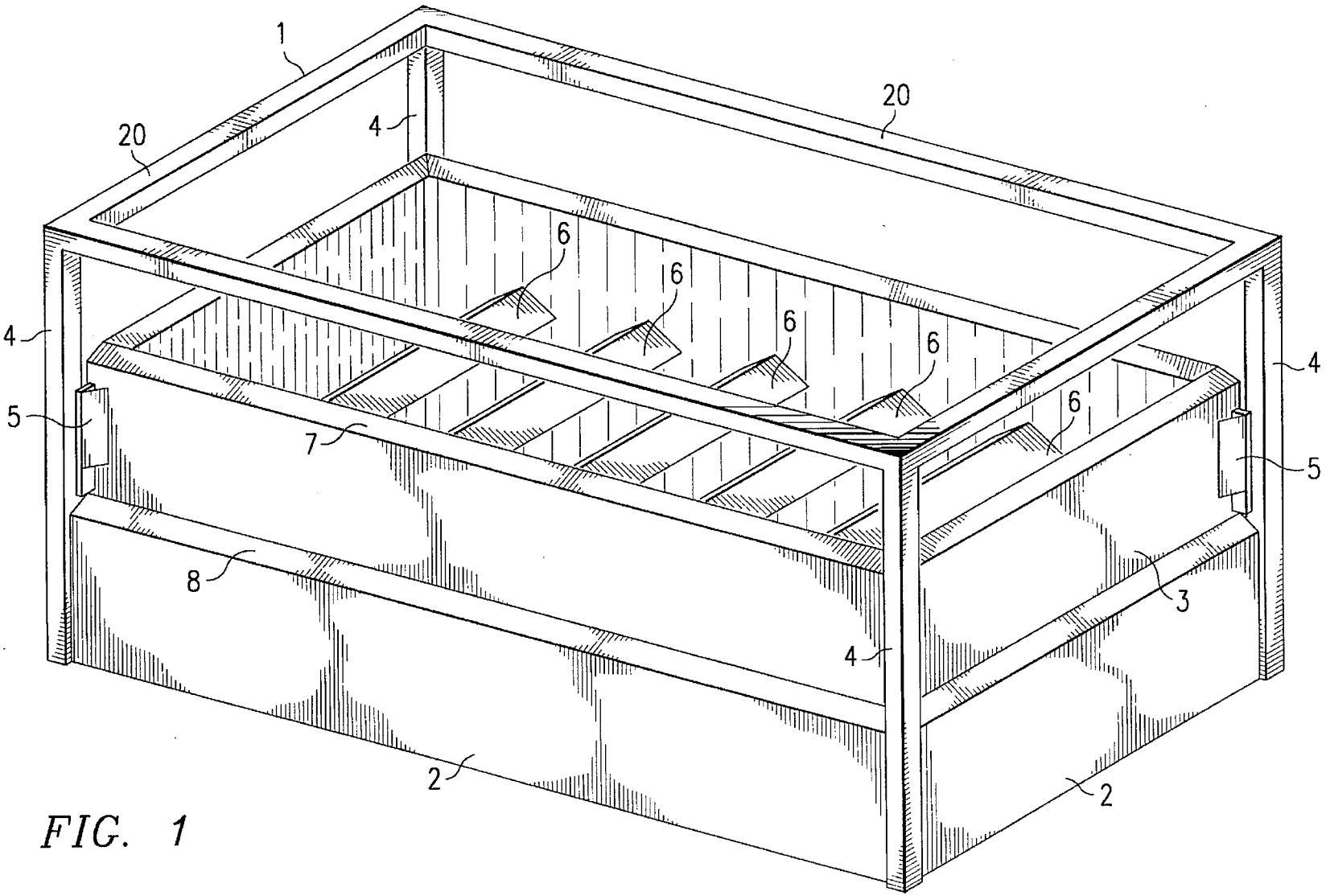
FIG. 1 is a perspective view of apparatus for storing and dispensing bulk material constructed in accordance with the principles of the present invention.

In FIG. 1, the apparatus according to the invention, is shown in a perspective view. It is comprised of a frame 1 with four vertical struts 4, which may be welded together with square tubes, and which are connected by horizontal struts 20 at their upper ends or portions. In the lower part of the frame 1, metal side plates 2 are welded in at all four sides. A container 3 is lowered into this frame 1 in such a way that it can be moved along the vertical struts 4. In addition to that, guides 5 are attached to the corners of the container 3, which are further described in FIGS. 6 and 7. The inside of the container 3 shows roof-shaped connecting struts 6, which connect and strut the longitudinal walls of the container 3. The upper edge of the container 3 as wells has a reinforcing roof-shaped strip 7, which may be connected through welding. At the same time, this strip serves as a device which prevents any bulk material from remaining on the edge. Around the container 3 runs another strip 8, which is welded to the container and tilted downwardly and outwardly, and which covers the upper edge of the metal side plates 2 in the position of the container 3 according to FIG. 1, as well as the space between the metal side plates 2 and the container 3. Instead of level metal side plates 2, as shown, flat scoops or corrugated metal sheets can be used according to the invention. The ribs of the corrugated metal sheets would run horizontally.

Figure 2:
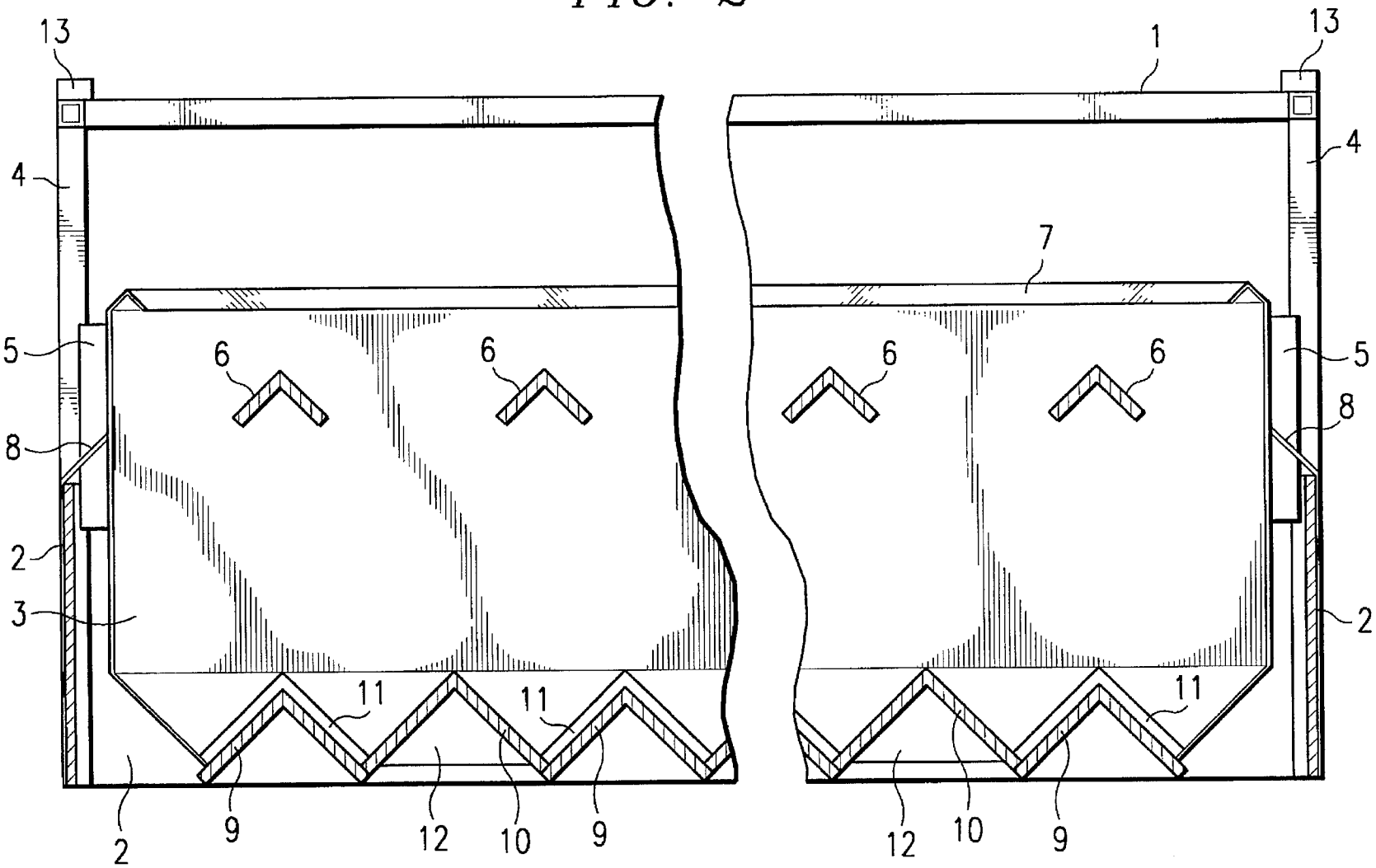
FIG. 2 is a longitudinal sectional view of the apparatus illustrated in FIG. 1 in which the apparatus is in the closed position.

FIG. 2 shows the apparatus of FIG. 1 as a longitudinal section. It shows that the container 3 is retracted in its lower part in the form of a truncated pyramid. The base aperture of the container 3 is closed by a multitude of roof-shaped webs 9 and 10. The webs 9, which are vertically hatched in FIG. 2, are welded together with the metal side plates 2 which run the length of the frame 1, and the vertically hatched webs 10 in FIG. 2 are welded to the container 3. Short pieces of webs which are welded to the container 3 are marked with the number 11. They strut the bottom edge of the container 3; their dimensions and their position are given more exactly in FIGS. 4 and 5.

A pair of vertically running plates 12 are connected to each of the plurality of roof-shaped webs 10 which are connected to the sides of container 3; one of each is drawn in side view in FIG. 2. One each of the two plates 12 is positioned at opposite ends of each of the roof-shaped webs 10 and on the downward-facing surface of each of the roof-shaped webs 10. Their function is further explained in FIG. 3. In FIG. 2, the frame 1 and the container 3 are shown in a closed position and can be loaded with the bulk material ready to be transported. There are four load take-up devices 13 in the four upper corners of the frame 1 (only drawn schematically), to which means may be attached in order to lift the frame 1 and container 3. Another option is to drive underneath the metal side plates 2 of the frame 1 with the forks of a lifting truck.

Figure 3:
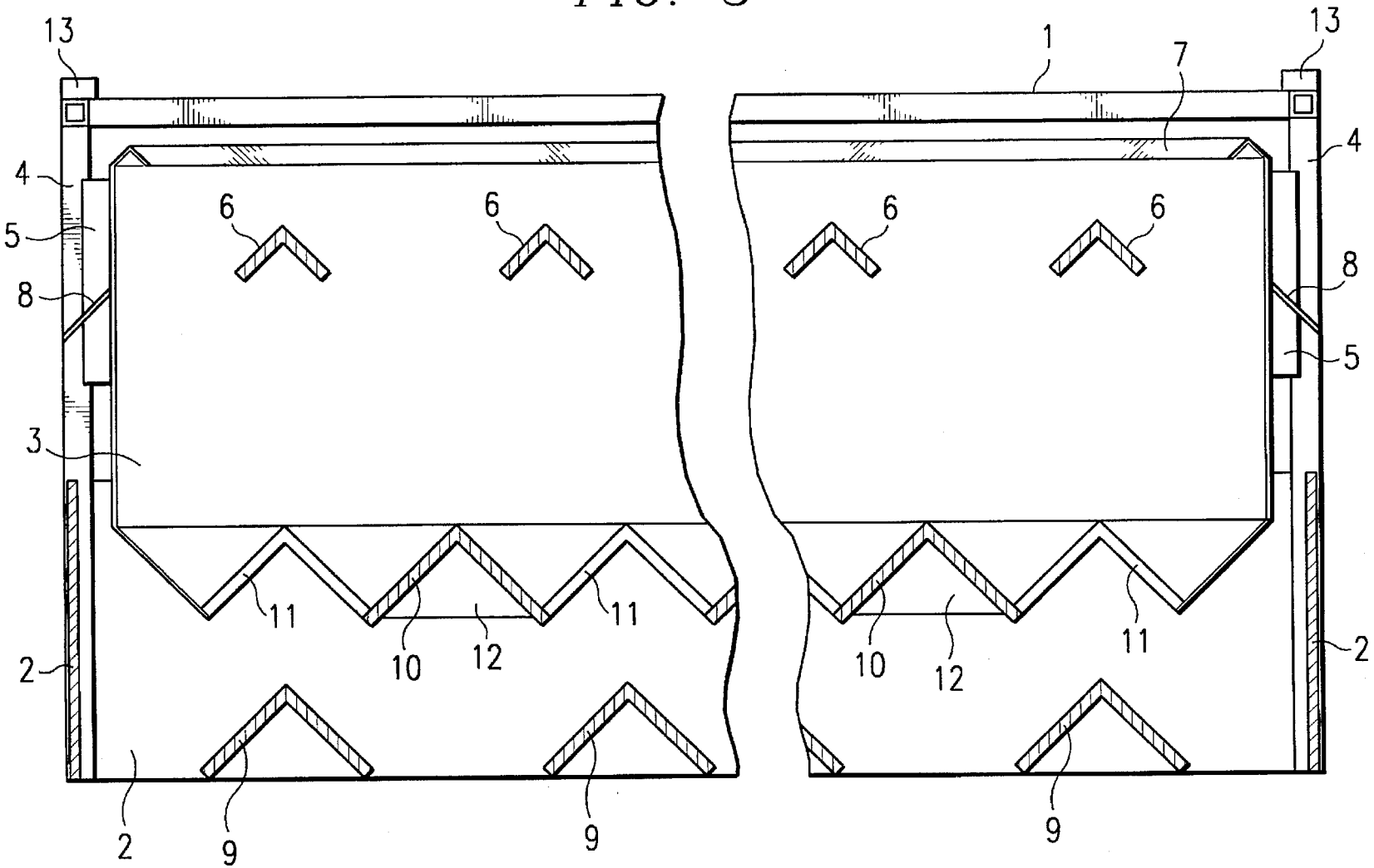
FIG. 3 is a longitudinal sectional view of the apparatus illustrated in FIG. 1 in which the apparatus is in the open position.

In FIG. 3 the frame 1 and container 3 are shown in an open or emptying position. It will be appreciated that if the loaded container 3 is, for example, put down on two transversely running beams which merely support the vertical plates 12 and the frame 1 is lowered past and below these beams, while guided by guides 5, the apertures, which were closed by the webs 9 and 10 will be opened or released. Instead of supporting the container 3 and lowering the frame 1, this relative motion can also be produced by positioning the frame 1 on a foundation, and by lifting the vertical plates 12 using a hoist. Thus the emptying procedure can take place in a relatively controlled manner.

Figure 4:
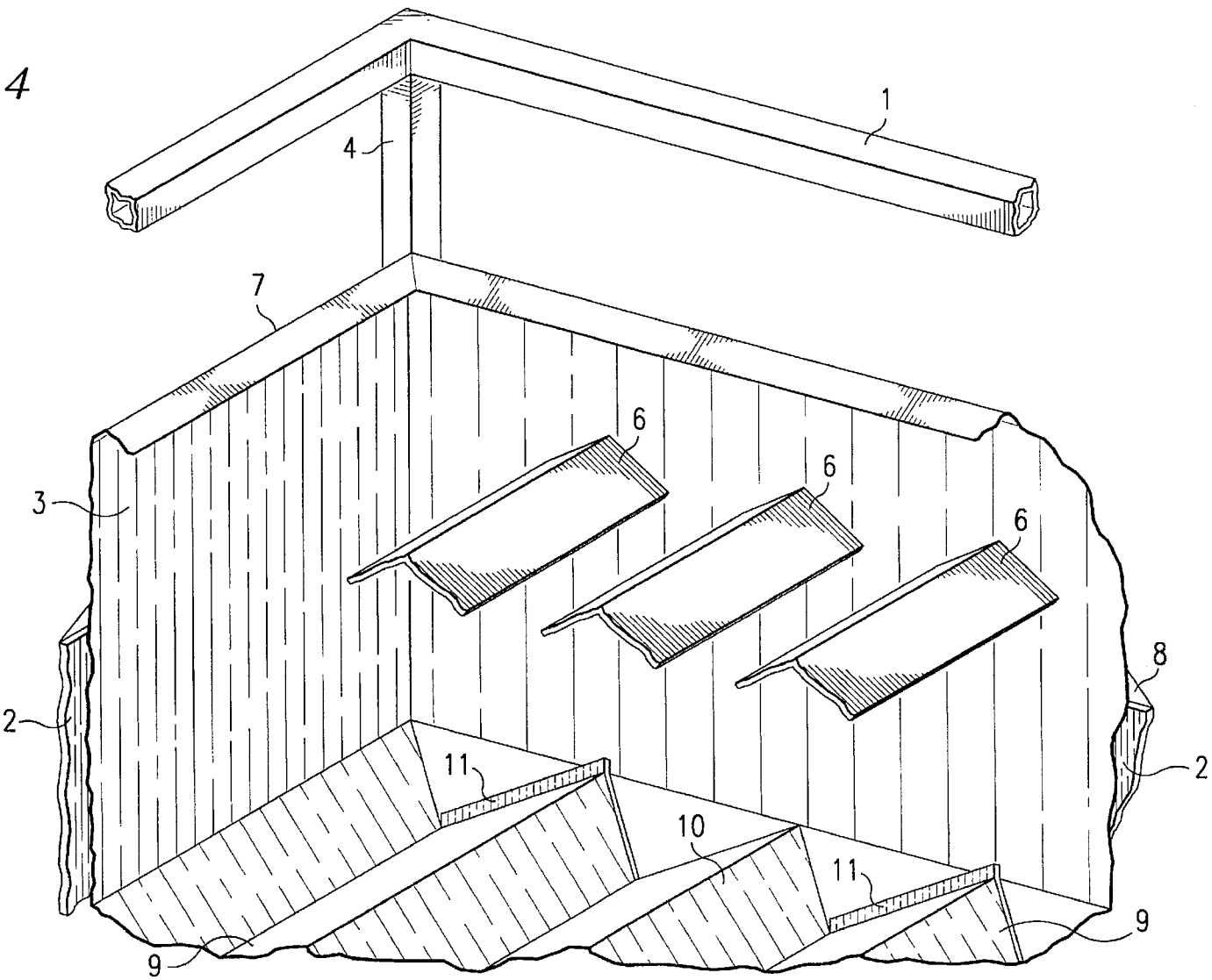
FIG. 4 is a perspective view, on an enlarged scale, of a portion of the interior of the container of the present invention.

FIG. 4 shows a perspective view into the inside of the closed container 3. The walls and two of the upper connecting struts 6 (broken off) of container 3 are visible. The webs 9 and 10, together with the front sides of the short webs 11, are visible as well.

Figure 5:
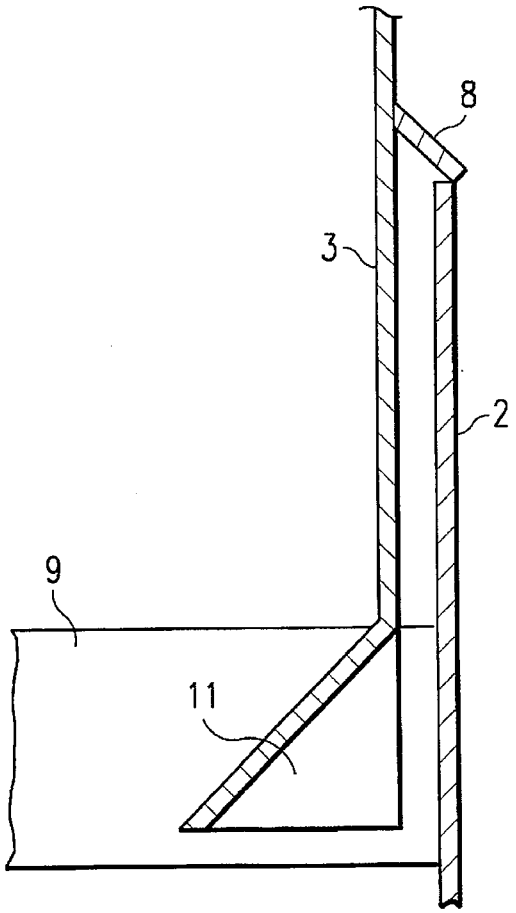
FIG. 5 is a cross-sectional view of a portion of the sidewall of the container, the sidewall and the roof-shaped web of the frame of the present invention.

FIG. 5 shows a cross-section of details of the container and frame, which depicts the place where the short webs 11 are attached to the container 3.

Figure 6:
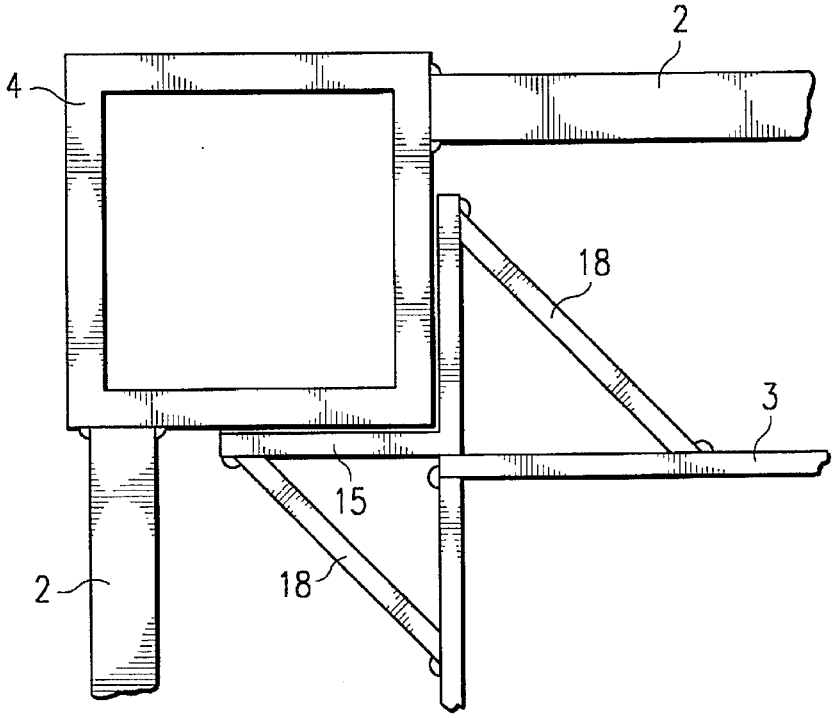
FIG. 6 is a top view of a portion of a corner of the frame, the corner of the container and the guide attached to the corner of the container of the present invention.

FIG. 6 shows a sample design of the guide 5. A steel angle 15 is welded to the corner of the container 3. Two surfaces of steel angle 15 lay flat against two sides of the vertical strut 4, but its sides are just long enough to be able to slide past the metal side plates 2 with sufficient clearance. The steel angle 15 is reinforced by a supporting metal plate 18, which runs, for example, across the entire length of the steel angle 15. Every corner of the container 3 has a guide 5 attached in the described manner.

A first variation to this has plastic sliding plates, which are inserted between the vertical strut 4 and the steel angle 15. A second variation appears in FIG. 7.

Figure 7:
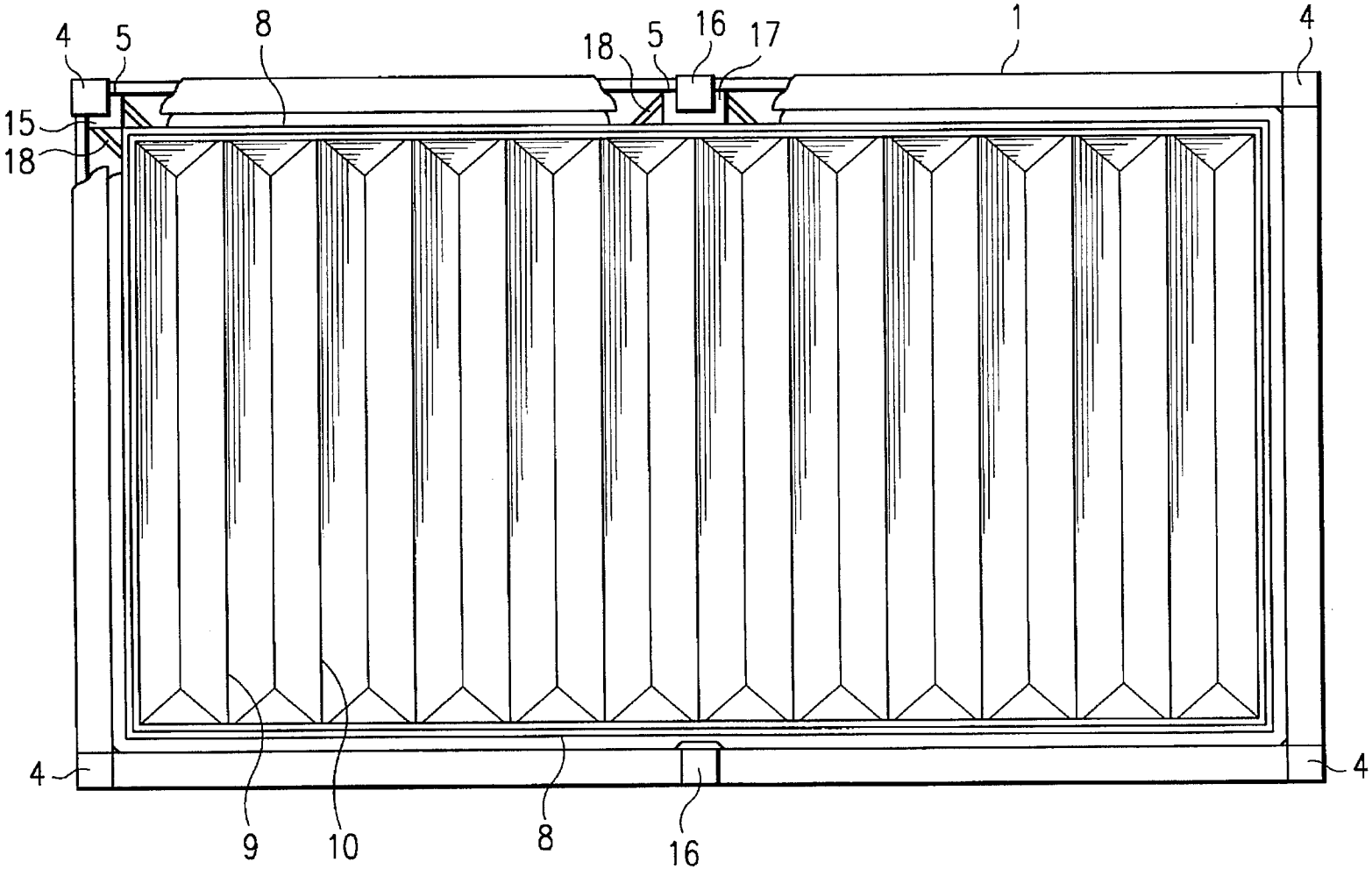
FIG. 7 is a top plan view of an additional embodiment of the present invention.

FIG. 7 shows a schematic top view of one of the variations of the apparatus according to the invention as shown in FIGS. 1–6. This variation has 6 instead of just 4 vertical struts; at the longitudinal sides of the frame 1 are two additional vertical struts 16. The guides 5, which are represented at the four corners in FIG. 6, are modified for use with the vertical struts 16 in such a way that, instead of the angle 15, a U-profile 17 is used.

The variation shown in FIG. 7 can of course be expanded to a total of eight or more vertical struts 4 and 16.

It will be appreciated that instead of using guides 5 with sliding surfaces, it is structurally possible to replace the sliding surfaces of the steel angles 15 and the U-profiles 17 with rollers, which move along the vertical struts 4 and 16.

In principle, the apparatus shown in FIG. 1 through 7, according to the invention, can be produced in any desired size. Modifications concern only static elements, not elements which are essential to the invention. Thus, its design as an ISO standard-container is of course intended for railroad and ship transportation. The load take-up devices 13 (shown only schematically) are then to be designed as devices corresponding to ISO standards; the corresponding devices at the four base corners are to be designed accordingly. Advantages of the invention are, among other things, that the container construction is simple and robust, and that its production costs are economical. Instead of storing different grain sizes of bulk material in expensive silos, which are often not fully used to capacity, this bulk material can be stored in the containers, according to the invention, which often saves unnecessary reloading procedures. Further, costly train hoppers can be eliminated. The containers are unloaded by universally usable railroad container wagons, and are lifted onto a relatively simply-designed emptying device and thus are emptied. If the containers are not to be emptied at first, they can be stacked (for example as ISO standard containers). Thus the transportation train becomes available at once, and no silo capacity will be necessary.

A further advantage is the fact that the apparatus (except container 3) has no movable parts, no drives, and no lids. Thus it is not necessary to build, to finance, and to maintain parts which are expensive, which are used only rarely, and which are prone to faults; the necessary investments can be reassigned to the unloading stations, which reduces the capital investment substantially, and makes maintenance easier.

While particular embodiments of the present invention have been described, it will be appreciated by those skilled in the art that various modifications, alternatives, variations, etc., may be made without departing from the spirit and scope of the invention as defined in the appended claims.

What is claimed is:

1. Apparatus for storing and dispensing bulk materials and which has at least one base emptying aperture, said apparatus comprising:

(a) a frame which is formed in the general shape of a rectangular box having a length, a width, an upper portion and a lower portion, said frame comprising:

(1) vertical struts formed of square tubes having an upper end portion and a lower end portion;

(2) horizontal struts which are connected to the upper end portion of the vertical struts;

(3) metal side plates which are connected to the lower end portion of the vertical struts; and (4) a plurality of roof-shaped webs positioned horizontally in the lower portion of the frame and extending between the metal side plates extending along the length of the frame and connected thereto, the plurality of roof-shaped webs are positioned along the length of the frame to provide an aperture between adjacent roof-shaped webs; and (b) a container which is formed in the general shape of a rectangular box for vertical movement within the frame and having a length, a width, an upper portion and a lower portion, said upper-portion having an upper edge, said container comprising:

(1) a guide attached to each corner of the container for vertical movement with respect to the adjacent vertical strut of the frame;

(2) a plurality of roof-shaped connecting struts positioned horizontally in the upper portion of the container and extending between the sides extending along the length of the container and connected thereto;

(3) the lower portion of the container is retracted in the shape of a truncated pyramid and includes a plurality of roof-shaped webs which extend between the sides extending along the length of the container and connected thereto, the plurality of roof-shaped webs are positioned along the length of the container to provide an aperture between adjacent roof-shaped webs such that a roof-shaped web is in vertical alignment with the aperture between adjacent roof-shaped webs of the frame when the container is positioned within the frame; and (4) two plates are connected to each of the plurality of roof-shaped webs which are connected to the sides of the container, one each of the two plates is positioned at opposite ends of each of the roof-shaped webs and on the downward-facing surface of each of the roof-shaped webs, whereby, when said container is moved upwardly relative to said frame, the apertures between adjacent roof-shaped webs in said frame and the apertures between adjacent roof-shaped webs in said container open to release the bulk material in the container.

2. The apparatus as set forth in claim 1 further including:

(a) a roof-shaped strip welded to the upper edge of the container and extending completely around the edge of the container;

(b) an outwardly and downwardly positioned strip attached to the outside of the container and extending completely around the container so that when the container is positioned down in the frame in a closed position, the outwardly and downwardly positioned strip extends over and covers the space between the walls of the container and the metal side plates of the frame; and (c) a roof-shaped web is attached to the retracted edge of the container where the container contacts the roof-shaped webs of the frame when the container is positioned within the frame to close the apertures, the roof-shaped web extends from the retracted edge of the container to the metal side plates of the frame.

3. The apparatus as set forth in claim 1 wherein the vertical struts comprise four in number and the container includes four guides which lie flat against two sides of the square tubes which comprise the vertical struts of the frame, each guide is strutted to the container by two support plates.

4. The apparatus as set forth in claim 3 wherein the container includes a guide in each corner of the container, each guide is formed at an angle such that the guide lies flat against the two surfaces of the vertical strut which are closest to the container and are formed to slide along the two surfaces of the vertical strut, the guides extend horizontally a maximum distance which still allows the guides to move past the metal side plates without contact therewith.

5. The apparatus as set forth in claim 4 wherein said guides slide directly along the vertical struts.

6. The apparatus as set forth in claim 4 wherein said guides include slide plates.

7. The apparatus as set forth in claim 1 wherein said frame includes at least six vertical struts which are formed of square tubes, four of the vertical struts form the corners of the frame while the other two vertical struts are positioned along the length of the frame.

8. The apparatus as set forth in claim 7 wherein the container includes:

a guide in each corner of the container, each guide is formed at an angle such that the guide lies flat against the two surfaces of the vertical strut which are closest to the container and are formed to slide along the two surfaces of the vertical strut, the guides extend horizontally a maximum distance which still allows the guides to move past the metal side plates without contact therewith; and a guide operatively positioned with respect to each of the vertical struts positioned along the length of the frame and having a generally U-shaped profile whose three surfaces lie flat against the three surfaces of the vertical strut which are closest to the container and are formed to slide along the three surfaces of the vertical strut, the guides extend horizontally a maximum distance which still allows the guides to move past the metal side plates without contact therewith.

9. The apparatus as set forth in claim 8 wherein said guides slide directly along the vertical struts.

10. The apparatus as set forth in claim 8 wherein said guides include slide plates.

11. The apparatus as set forth in claim 1 further including a load take-up device in each of four corners of the frame to which means are attached for lifting the apparatus.

12. The apparatus as set forth in claim 11 wherein each load take-up device meets the standard for international railway traffic and shipping.

* * * * *